US005775221A

United States Patent [19]

Bill

[11] Patent Number: 5,775,221

[45] Date of Patent: Jul. 7, 1998

[54] PRINTING MACHINE

[76] Inventor: Ralph J. Bill, 5494 McFadden, Huntington Beach, Calif. 92649

[21] Appl. No.: 918,290

[22] Filed: Aug. 25, 1997

[51] Int. Cl.[6] ..... B05C 17/06

[52] U.S. Cl. ..... 101/128.1; 101/127.1

[58] Field of Search ..... 101/127, 127.1, 101/128, 128.1

[56] References Cited

U.S. PATENT DOCUMENTS

| | | | |
|---|---|---|---|
| 3,946,668 | 3/1976 | Douthwaithe | 101/123 |
| 4,063,502 | 12/1977 | Cunningham | 101/123 |
| 4,073,232 | 2/1978 | Brewer | 101/126 |
| 4,438,693 | 3/1984 | Serrianne et al. | 101/35 |
| 4,649,815 | 3/1987 | Richardson | 101/126 |
| 4,679,501 | 7/1987 | Hanosh | 101/114 |
| 4,708,057 | 11/1987 | Hogenson | 101/129 |
| 4,738,909 | 4/1988 | Jennings | 430/22 |
| 4,911,070 | 3/1990 | Miske et al. | 101/126 |
| 4,936,212 | 6/1990 | Moss | 101/216 |
| 5,014,614 | 5/1991 | Thieme | 101/35 |
| 5,018,441 | 5/1991 | Miraglia, Jr. | 101/123 |
| 5,081,507 | 1/1992 | Monkelbaan et al. | 355/309 |
| 5,094,160 | 3/1992 | Jennings | 101/127.1 |
| 5,127,321 | 7/1992 | Proffer | 101/115 |
| 5,503,086 | 4/1996 | Hoffman et al. | 108/138 |

*Primary Examiner*—Ren Yan
*Assistant Examiner*—Dave A. Ghatt
*Attorney, Agent, or Firm*—James G. O'Neill

[57] ABSTRACT

A printing machine has a box frame rotatably holding an attachment arm to which various size workpiece supporting means may be connected. A series of screen frames are secured over a workpiece support, secured to the attachment arm in exact registration, so that numerous colors may be sequentially printed on a material held on the workpiece support. The attachment arm and workpiece support can be pivoted in one direction to mount a non-planar workpiece to be printed thereon, and then allowed to return to a rest position to mount a series of screen frames thereon for sequentially printing different images and colors on the workpiece held on the workpiece support, below the screen.

20 Claims, 5 Drawing Sheets

PRINTING MACHINE

BACKGROUND OF THE INVENTION

1. Field of the Invention

This invention relates generally to printing machines and, more particularly, to an improved printing machine for quickly and accurately printing on various substrates, using various screen registration systems.

2. Description of Prior Art

As is well known, many types of materials and products may be printed utilizing what is referred to as stenciling or silk screening. Many such screen printing applications involve the printing of intricate designs utilizing a plurality of colors, requiring a high degree of precision. Therefore, to provide the necessary precision in known printing machines, various registration systems are used to initially align multiple silk screens in registration to one another. This has become increasingly more important because of the multiple short runs printed on today's machines. That is, in today's printing environment, many different types of items or materials, such as caps, jackets, shirts, shorts, or various substrates, each bearing a different multi-color design, are printed in small quantities. Therefore, the consecutive print screens used to print such small volumes of work must be properly positioned, as quickly as possible.

U.S. Pat. No. 5,127,321 to Proffer ("'321"), in columns 1 through 3 thereof, discloses the problems associated with the registration of multiple screens in prior art printing machines. The disclosure of these columns 1 through 3 of the '321 patent are incorporated herein by this reference thereto.

U.S. Pat. No. 4,649,815 to Richardson discloses a movable screen printing head assembly having a fixed platen with a movable screen holding carriage mounted over the platen so as to print various numerals in different sizes on an athletic jersey in two colors.

Additionally, U.S. Pat. No. 4,911,070 to Miske et al. discloses an apparatus having a storage cabinet for holding a stack of color-coded screen units with a stationary screen-supporting structure having pins therein to hold screen units in position over a platen. The platen is linearly and laterally manually movable so as to print various numerals in different sized athletic jerseys.

Various other U.S. Patents such as U.S. Pat. Nos. 4,438,693 to Serriane et al., 4,679,501 to Hanosh, 4,708,057 to Hogenson, 4,738,909 to Jennings, 4,936,212 to Moss, 5,018,441 to Miraglia, Jr., 5,081,507 to Monkelbaan et al., and 5,094,160 to Jennings discloses other registration systems for automated or mechanical printing machines having a plurality of print screens, which attempt to solve the known problems, as indicated therein. Some of these patents include pin registration systems. None of these patents, however, disclose a printing machine which has a single printing station with changeable locator means and platens for printing in a plurality of colors, and which provides accurate printing registration, before quickly printing items, or for ensuring the registration of multiple screens by printing images before using the multiple screens on an automated machine.

Therefore, although the registration processes and systems shown in the prior art solve many of the problems with accurate printing of workpieces, and attempt to solve the problems that occur because of the problems associated with registering multiple screens, there still exists the need in the art for a process and/or system to solve the many problems with accurate alignment of screens, before placement of the screens on an automated printing machine, or which accurately and efficiently prints multiple or single pieces in a variety of colors, using available registration systems, in a more desirable and efficient manner, and saving valuable floor space.

SUMMARY OF THE INVENTION

Accordingly, it is a general object of the present invention to provide an improved printing machine. It is a more particular object of the present invention to provide an improved printing machine having means to lift and lower a platen, allowing non-planar items to be mounted thereon for printing. It is a further object of the present invention to provide an improved printing machine having a rotatable attachment arm. It is yet a further object of the present invention to provide an improved printing machine capable of easily printing in an unlimited number of colors. It is still a further particular object of the present invention to provide an improved printing machine, having quickly removable platen means and means for the accurate printing of multi-color workpieces held on the platen means. It is yet another particular object of the present invention to provide an improved printing machine having a rotatable attachment arm with a removable workpiece support means held thereon, which first lifts the support means to a position where a workpiece may be placed onto the support, and then lowers the support means and workpiece to a prone position whereby consecutive screens may be accurately mounted thereon using locating means secured in a frame, for accurately sequentially printing multiple screens in a variety of colors on the workpiece.

In accordance with one embodiment of the present invention, a printer comprises a box frame for use with a series of screen frames utilizing a registration system, such as a pin registration system. The series of screen frames hold different silk screens, which are used to sequentially print designs/words/etc. on items of clothing, textiles, or other materials, in multiple colors. The printer quickly prints a series of workpieces, or prints a single workpiece to insure that each screen frame in a series is properly aligned, vis a vis a printing pallet or platen, before the screens frames are moved to an automated machine for a high speed run of a larger number of items, eliminating the need for costly and time-consuming registration on the automated machine.

The box frame of the printer of the present invention includes a removable locator bar or registration means thereon. This locator bar may have a number of fixed or retractable pins or other registration means, such as at opposite ends thereof, for insertion and capture into openings or other registration means on various screen frames. The box frame also includes an attachment arm rotatably mounted therein. The attachment arm has a series of spaced-apart openings for removably holding various sized workpiece supporting means, such as pallets or platens. The attachment arm, with a workpiece supporting means secured thereon, is rotated between a lowered rest position and an upper position so that an item to be printed may be inserted over the workpiece supporting means. The attachment arm is then returned to its lowered position for printing on the item. The attachment arm is rotated by means of a foot or power driven means through appropriate drive means.

With the attachment arm, workpiece support means and item to be printed in the lowered position on the machine frame, selected screen frames are then placed on the frame over the workpiece support means, in accurate alignment with the item to be printed, by the locator registration means. After registration, each successive screen frame is clamped in position, by a movable clamp means, to allow an item to be printed by sequential, accurately aligned screen frames.

BRIEF DESCRIPTION OF THE DRAWINGS

The objects and features of the present invention which are believed to be novel, are set forth in particularity in the appended claims. The present invention, both as to its organization and manner of operation, together with further objectives and advantages, may best be understood by reference to the following description, taken in connection with the accompanying drawings, in which:

DESCRIPTION OF THE PREFERRED EMBODIMENTS

Figure 1:
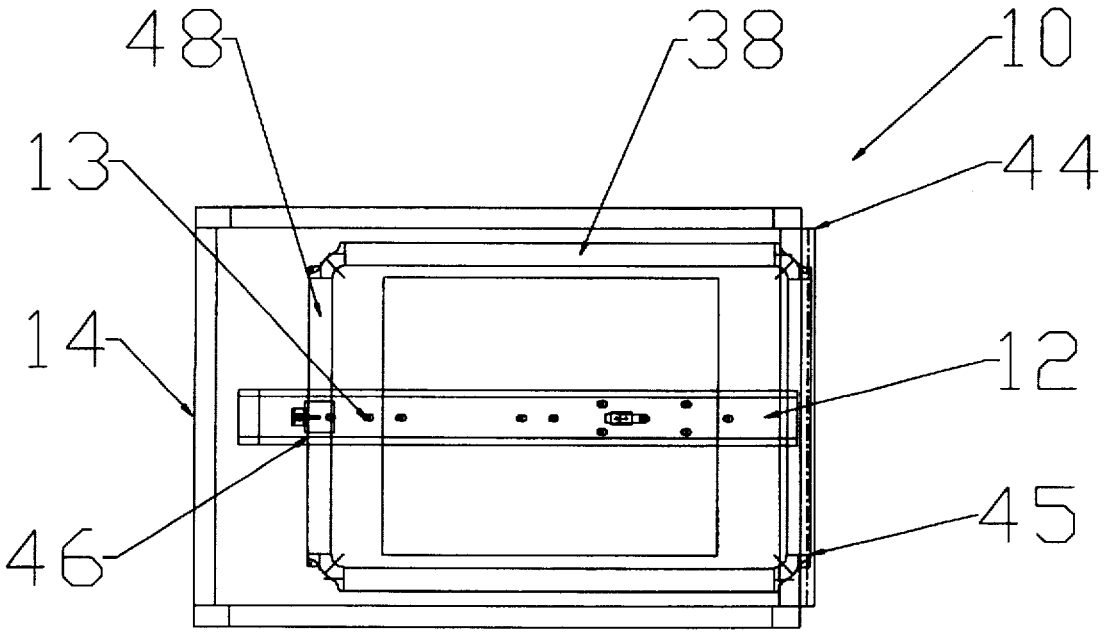
FIG. 1 is a top plan view of one embodiment of a printing machine of the present invention, showing a removable workpiece support means held on a movable attachment arm.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved printing machine, with a rotatable attachment arm, having removable workpiece supporting means, as well as means for rotating the attachment arm to enable workpieces to be more easily placed on the workpiece supporting means for printing. The printer includes means to more positively align screen frames on the printer to enable the printing machine to more accurately print workpieces in a plurality of colors, in a minimum period of time, with no restriction on the number of colors, such as with known machines.

Turning now to the drawings, there shown is a novel printing machine 10 having an attachment arm 12, which is preferably rotatable and includes a plurality of holding means 13, such as spaced-apart openings therein. The machine 10 can be moved, and includes a substantially rectangular box frame 14 having a series of levers 16, 18, 20 (see FIG. 2) rotatably mounted therein, to enable the attachment arm 12, and any size workpiece supporting means 22, such as a pallet or platen, secured thereto to be rotated upwardly (see FIG. 3), in the direction of arrow 24, to allow some types of a workpieces, such as a tubular item, to be placed on or removed from the workpiece supporting means. The box frame is preferably of open construction and has a front end, a rear end, two sides, a bottom and a top, and the attachment arm 12 and attached workpiece supporting means 22 are rotated in the box frame, around a pivot, by a force, such as a foot or pneumatic means, applied against a plate 28, or the like, at the outer end or some other point of lever 16, toward the front end of the box frame. When lever 16 moves downwardly, lever 18 will rotate around a pivot 30 (see FIG. 3), since an inner end of lever 16 is secured thereto. Lever 18 will be moved or rotated around pivot 30, in the direction of arrow 32, to cause a roller means 34, mounted at an outer end of the lever 18, to move or rotate lever 20, secured to an inner end of attachment arm 12, at pivot 36, to thereby move the attachment arm 12 and attached workpiece supporting means 22, around pivot 36, in the direction of the arrow 24, to the open position. Removal of the force from plate 28 allows all of the elements to rotate, by gravity or reverse pneumatic pressure, back to their rest positions, shown in FIGS. 1 and 2. Attachment arm 12 is preferably an elongated, substantially rectangular element having its inner end rotatable about pivot 36, and its outer end adjacent one end, such as the front of the box frame 14.

The support means 22 may take any desired shape, and/or be made of any material, in any size. The lower surface of the support means 22 is secured to the attachment arm 12 by securing means 26, such as pin means formed on or secured thereto, which are insertable and/or slidable into a plurality of selected holding means 13 on the attachment arm and held thereon by further securing means formed in the attachment arm, such as a rotating clip or sliding means cooperating with one or more of the securing means 26. It, therefore, can be seen that a plurality of support means of different sizes and shapes, usually made from metal or some other strong, stiff material, may be easily removably secured to attachment arm 12, to enable different size tubular, or other workpieces to be printed on the machine.

Figure 2:
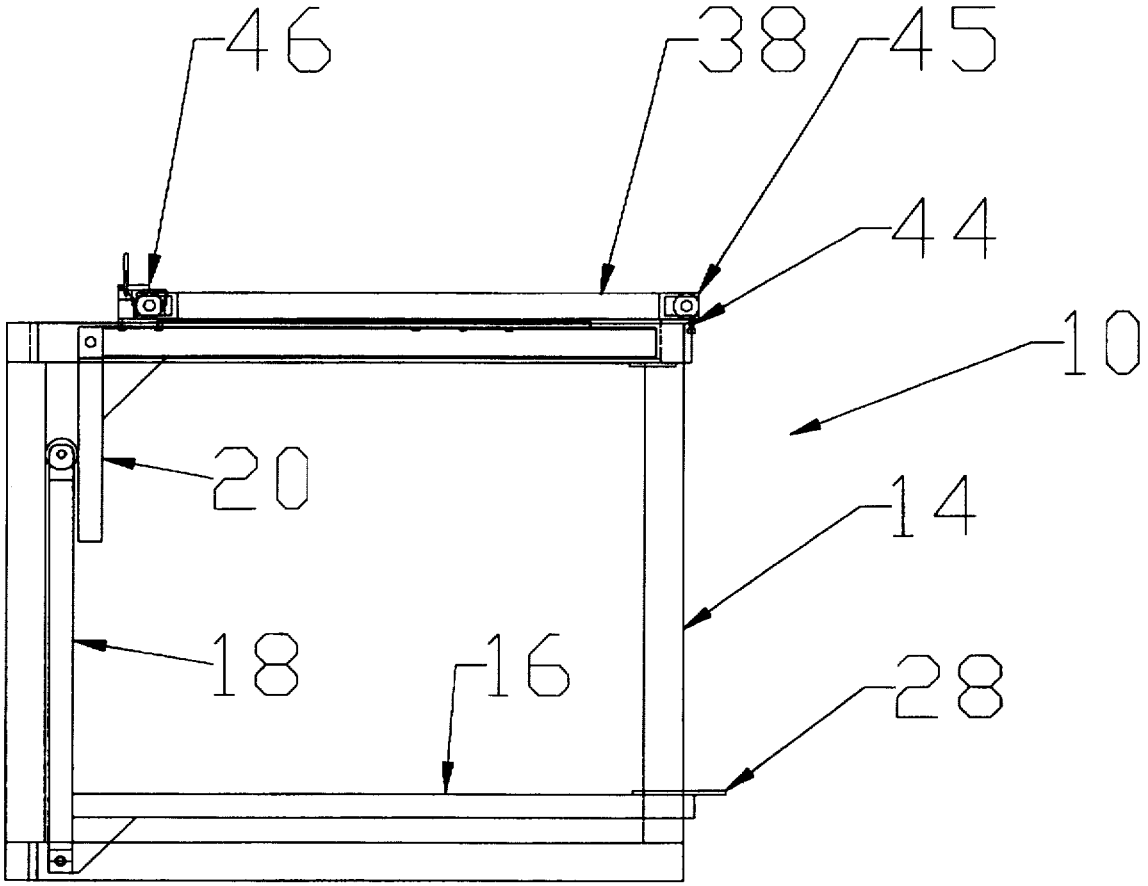
FIG. 2 is a side elevational view of the printing machine of FIG. 1.
Figure 3:
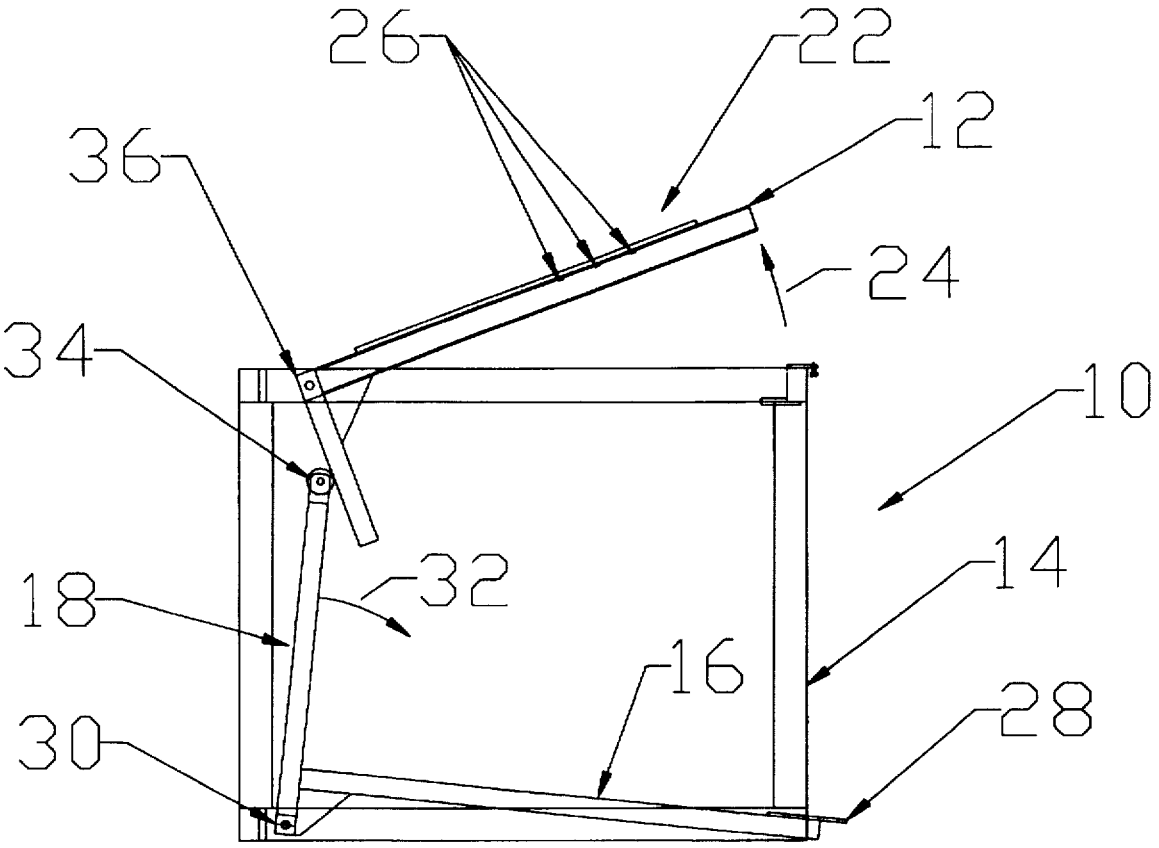
FIG. 3 is a further side elevational view of the printing machine of FIG. 1, with the attachment arm and attached workpiece supporting means in an upwardly rotated position, for the placement of a workpiece to be printed onto the workpiece supporting means.
Figure 4:
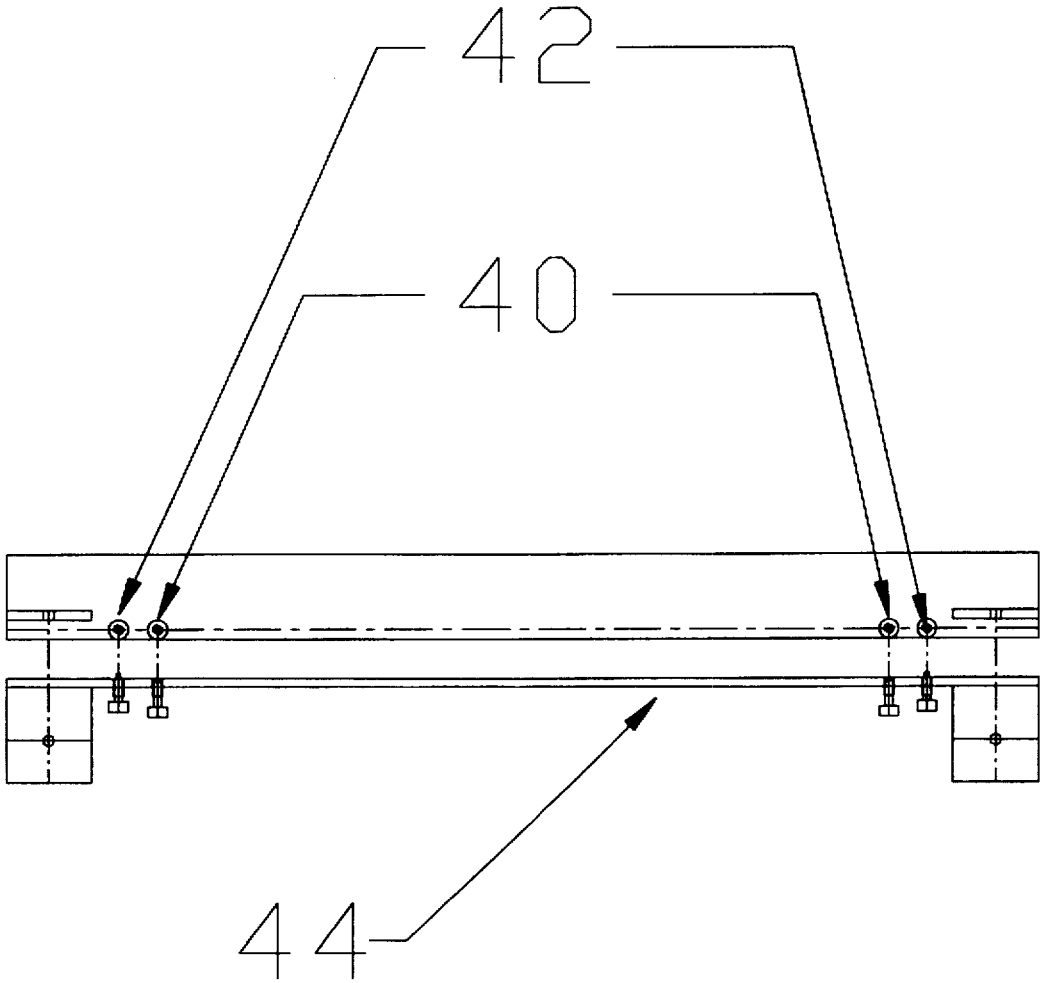
FIG. 4 is a front elevational view of one embodiment of a locator means.
Figure 5:
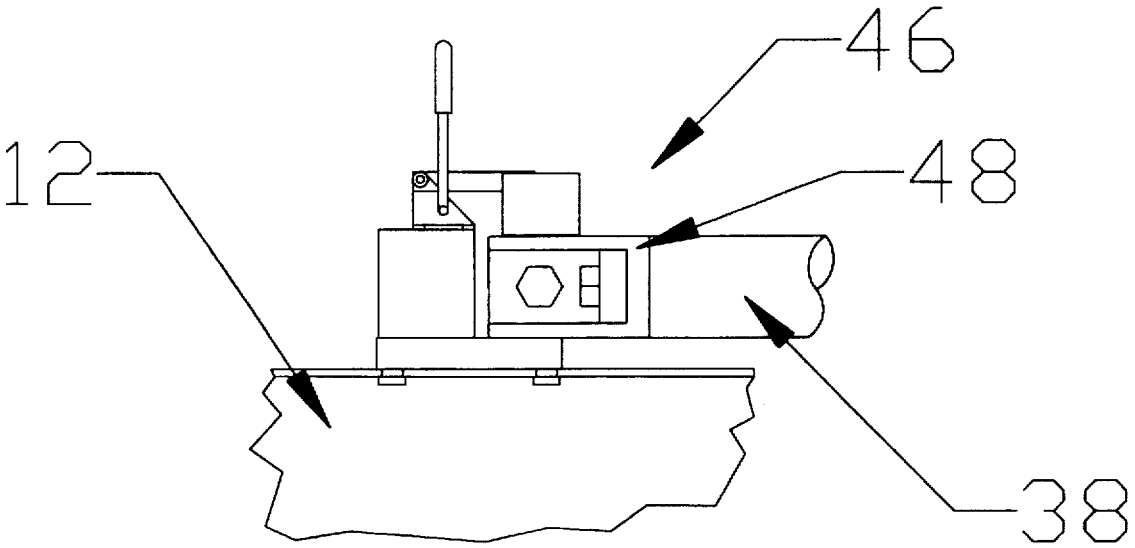
FIG. 5 is an enlarged, partial, side elevational view of one embodiment of a movable clamp holding a screen frame in place, over a workpiece supporting means.

As shown most clearly in FIGS. 1, 2 and 5, a selected screen frame 38, having a silk screen held therein, is secured to the printing machine 10, over the support means 22 and any workpiece held thereon. The screen frame 38, may be any type well known to those skilled in the art, and may include any of the available registration means, to ensure that each screen to be printed, when placed thereon, is accurately aligned and positioned, so as to accurately print in the desired color. By way of example, but not limiting the invention, the screen frame 38, shown and described, is a roller frame, and includes a two-pin type Newman® registration system (i.e., openings), which cooperate with a pair of differently spaced pins 40, 42 on a locator means 44, such as a bar (see FIG. 4), removably secured to the box frame 14 at any desired position, such as the front end or side thereof. Each pair of pin means 40, 42 are used with different size screen frames. The pair of pins not used, may be retracted and held in this retracted position, as by a pull down and lock, so that a different pair of pins (one on each end of bar 44) are used with different sized screen frames 38. Other registration means may have fixed pins, consisting of a plurality of pins, with a different configuration for each frame size, on separate locator bars.

The locator means 44 is removably secured on the front, side or above the frame 14, by any type of acceptable securing means, such as bolts, speed handles, or the like, held in corresponding openings in the box frame. A first end or side 45 of the screen frame 38, having registration means, such as holes, a point, slots, or edges, or one opening and a slot therein, are aligned with at least one locating means, such as a protruding pin or pair of pins 40 or 42, and then secured in place over the support means 22 on the attachment arm 12. After being registered, the screen frame 38 is preferably held in place by a holding means 46, such as a clamping means, removably secured in the securing means 13, adjacent the other or secured end 48 of screen frame 38. The holding or clamping means 46 is rotatable between a closed position, such as shown in FIGS. 1, 2 and 5, to an open position, away from the other end 48 of the screen frame.

Other registration systems, such as those utilizing blocks, corner registration means, end stops, one or more pins, or combinations thereof can also be used on the printing press of the present invention. For example, the locator bar 44 could have a plurality of removable blocks held in openings thereon, and/or a further plate or arm could be added at one end of the bar, extending perpendicularly thereto, along or parallel to an end or side of the frame 14, and a third pin means formed at a selected position on such arm.

Thus, there has been described an improved and simplified printing machine having a movable attachment arm with means therein to removably hold and capture various size workpiece supporting means, to more economically print workpieces, and ensure that multiple screens are in registration or alignment to meet today's market need of more accuracy and speed. Any number of workpieces may now be printed on the sample press in any desired combination of colors, or a sample may be printed, to ensure accuracy of multiple screens, before a larger number of workpieces are printed on an automated printing machine by the multiple screens.

Those skilled in the art will appreciate that various adaptations and modification of the just-described preferred embodiment can be configured without departing from the scope and spirit of the invention. Therefore, it is to be understood that, within the scope of the appended claims, the invention may be practiced other than is specifically described herein.

What is claimed is:

1. A printer comprising, in combination:

an open construction frame, having a front, a rear, two sides a bottom and a top;

an attachment arm held in the top of the open construction frame, the attachment arm having two ends;

a plurality of spaced-apart holding means formed on the attachment arm for removably holding different size workpiece supporting means; and locator means held in the open construction frame adjacent one of the two ends of the attachment arm, the locator means including screen frame registration means held therein.

2. The printer of claim 1 wherein the different size workpiece supporting means have a first side and a second side, and the second side includes securing means held thereto, which securing means is releasably held in corresponding holding means in the attachment arm, by further securing means held in the attachment arm.

3. The printer of claim 1, further including a rectangular screen frame with a screen secured therein; the screen frame secured to the top of the open construction frame, over the attachment arm, workpiece supporting means and any workpiece held thereon.

4. The printer of claim 3 wherein the screen frame includes alignment means formed therein cooperating with the registration means on the locator means, to ensure alignment of the screen frame on the printer.

5. The printer of claim 4, further including clamping means, removably secured to the attachment arm and releasably holding the screen frame on the top of the open construction frame.

6. The printer of claim 1 further including means to rotate the attachment arm, including drive means held in the open construction frame.

7. The printer of claim 6 wherein the drive means comprises a series of levers, with a first end of a first lever having a plate thereon, against which a force is applied to rotate the attachment arm.

8. The printer of claim 7 wherein the first lever has a second end secured adjacent a first end of a second lever, which first end of the second lever is pivotally held in the open construction frame; and a roller means is secured to a non-pivoting end of the second lever, and contacts a third lever, secured to the attachment arm.

9. The printer of claim 8 wherein the open construction frame is a box frame and the attachment arm is substantially elongated, and has two ends, with one of the two ends of the substantially elongated attachment arm pivotally mounted in the box frame, adjacent one end of the top thereof.

10. The printer of claim 9, further including a screen frame having a screen secured therein releasably held on the top of the box frame, over the substantially elongated attachment arm.

11. The printer of claim 10 wherein the screen frame is releasably held on the top of the box frame by means of the locator means secured to the box frame and at least one clamp means attached in the box frame.

12. The printer of claim 11 wherein the clamp means is movable between an open position, away from the screen frame, to a locked position, against the screen frame.

13. The printer of claim 12 wherein said registration means cooperates with corresponding alignment means in the screen frame.

14. A printing machine, comprising, in combination:

an open construction box frame having a front end, a rear end, a pair of sides, a bottom and a top;

an elongated attachment arm having two ends, rotatably mounted in the top of the open construction box frame around one of the two ends;

means for removably holding different size workpiece supporting means on the elongated attachment arm;

a locator bar removably secured to the open construction box frame, adjacent the top thereof; and registration means held in the locator bar for cooperating with corresponding means formed in a screen frame.

15. The printing machine of claim 14, further including means held in the open construction box frame for rotating the attachment arm and a workpiece supporting means secured therein, between a rest position parallel to the top, and a raised position, away from the top, whereby a non-plannar workpiece may be mounted on the workpiece supporting means.

16. The printing machine of claim 15 wherein the means held in the open construction box frame for rotating the attachment arm, includes a plurality of levers, pivotally held in the open construction box frame.

17. The printing machine of claim 16 wherein there are three levers, with a first lever secured to a second lever, and the second lever pivotally mounted by a first end thereof, adjacent the bottom and rear end of the open construction box frame; the second lever having a second end with a roller means attached thereto; and a third lever secured to the attachment arm, cooperating with the roller means.

18. The printing machine of claim 14, further including a screen frame removably secured on the top of the open construction box frame, over the workpiece supporting means secured on the attachment arm and a workpiece held on the workpiece supporting means; the screen frame being rectangular and having a screen held therein; alignment means formed in the screen frame cooperating with the registration means held in the locator bar, and clamp means cooperating with the screen frame to clamp the screen frame and the frame in an aligned position over the workpiece supporting means and the workpiece.

19. The printing machine of claim 18 wherein the locator bar has two ends and the registration means is a plurality of pairs of pins, movably mounted in the locator bar, at the two ends thereof.

20. A printing machine, comprising, in combination:

an open construction box frame having a front end, a rear end, a pair of sides, a bottom and a top;

an elongated attachment arm having two ends, rotatably mounted in the top of the open construction box frame by one of the two ends;

a plurality of spaced-apart openings formed in a top surface of the elongated attachment arm for removably holding a workpiece supporting means and a screen frame clamping means;

a locator bar removably secured in the open construction box frame, adjacent the top thereof;

registration means held in the locator bar for cooperating with corresponding means formed in a screen frame; and a plurality of levers, pivotally mounted in the open construction box frame for rotating the attachment arm between raised and lowered positions.

* * * * *